US007464427B2

(12) United States Patent
Caponi et al.

(10) Patent No.: US 7,464,427 B2
(45) Date of Patent: Dec. 16, 2008

(54) METHOD FOR PRODUCING SHOES AND A SHOE OBTAINED BY THIS METHOD

(76) Inventors: Nello Caponi, Via Fonte Casella 2, Montegranaro, Ascoli Piceno (IT) 63014; Roberto Montagna, Via Montone 20, Montegiorgio, Ascoli Piceno (IT) 63025

( * ) Notice: Subject to any disclaimer, the term of this patent is extended or adjusted under 35 U.S.C. 154(b) by 0 days.

(21) Appl. No.: 10/540,382

(22) PCT Filed: Dec. 23, 2003

(86) PCT No.: PCT/IB03/06140

§ 371 (c)(1),
(2), (4) Date: Jun. 23, 2005

(87) PCT Pub. No.: WO2004/057991

PCT Pub. Date: Jul. 15, 2004

(65) Prior Publication Data

US 2006/0048409 A1 Mar. 9, 2006

(30) Foreign Application Priority Data

Dec. 27, 2002 (IT) ..... BO2002A0816

(51) Int. Cl.
*A43B 9/00* (2006.01)

(52) U.S. Cl. ..... 12/142 T; 12/142 R; 36/97

(58) Field of Classification Search ..... 12/142 RS, 12/142 T, 142 R, 142 C, 142 F; 36/88, 93, 36/97

See application file for complete search history.

(56) References Cited

U.S. PATENT DOCUMENTS 3,404,468 A * 10/1968 Rosen ..... 36/11
3,748,756 A 7/1973 White
5,123,181 A 6/1992 Rosen
5,241,762 A * 9/1993 Rosen ..... 36/97
5,259,126 A * 11/1993 Rosen ..... 36/93
5,325,614 A * 7/1994 Rosen ..... 36/97
5,813,145 A * 9/1998 Prober ..... 36/93
6,279,251 B1 * 8/2001 Davis ..... 36/97
7,155,845 B2 * 1/2007 Durand ..... 36/97

* cited by examiner

*Primary Examiner*—Ted Kavanaugh
(74) *Attorney, Agent, or Firm*—William J. Sapone; Coleman Sudol Sapone P.C.

(57) ABSTRACT

A method for producing shoes includes the following steps: obtaining an assembly (T,T1), formed by a shoe upper (2) and an elastic element, fastened to the shoe upper at least along the sections facing the lower edges of the shoe upper central-fore area; obtaining a sole (5), whose size corresponds to the size of the shoe upper, and whose upper surface has fastening means (50), engaging at least the central-fore portion thereof, so that the upper surface defines at least one fore fastening area (Z) and at least one rear fastening area (Z1); mutual fastening the fore fastening area (Z) of the sole (5) to a corresponding fore portion of said assembly, and of the rear fastening area (Z1) of the sole (5) to a corresponding rear portion of the assembly, to obtain a sole—assembly group (W,W1); introduction of a user's foot into the sole—assembly group (W,W1), with a subsequent transversal stretching of the elastic element (60) and adapting of the shoe upper (2) to the foot conformation; pre-fastening of the elastic element to the fastening means (50), by pressure of the user's foot onto the elastic element; removal of the user's foot from the sole—assembly group (W,W1); joining the sole—assembly group (W,W1), to obtain a shoe.

23 Claims, 4 Drawing Sheets

METHOD FOR PRODUCING SHOES AND A SHOE OBTAINED BY THIS METHOD

This application is a 371 of PCT/IB03/06140 filed on Dec. 23, 2003.

FIELD OF THE INVENTION

The present invention relates to the technical field concerning techniques for producing footwear.

PRIOR ART

The shoes are obtained by joining more parts, more precisely at least one shoe upper and a relative bottom (or sole).

In order to obtain the so-called assembled shoe, a shoe upper must be produced, which is formed by punched portions, or punchings, made from e.g. leather, joined one to another and lined inside, and which sometimes includes a toe cap for obtaining a stronger fore part of the shoe, and a counter for strengthening the shoe rear part.

The parts forming the shoe upper (punchings, lining, toe cap and counter) are often joined one to another by glue.

It is also necessary to produce an insole, whose size and shape match a relative shoe upper.

The insole is generally mounted on a last, to which it is fastened by suitable fastening means.

During a next step, a layer of glue is applied to the edge of the insole, the shoe upper is fitted onto the last, the shoe upper edge is folded and kept pressed, according to known techniques, against the insole situated below, in order to join the two elements.

After the shoe upper and the insole have been joined, the shoe upper is made to tightly adhere to the last, according to systems and techniques known to those expert in the field.

The so obtained assembly is joined to a relative sole by stitching and/or gluing.

The shoe upper of this kind of shoe is stretched on a last of a prefixed shape and, consequently the shoe upper assumes the shape of the last used for its stretching: the so obtained shoes have standard shape of the foot receiving space.

In case the user has a deformed foot, for example in a metatarsus-phalange portion, the described shoe is uncomfortable, because the shoe width and shape cause to the foot, in the areas, in which it touches the shoe, skin irritation, pain and sometimes small abrasions.

If the foot deformation is small, the shoe deforms either only by being used and with all above described discomforts, or by mechanical instruments which widen the shoe upper in its rear area.

If the foot deformation is severe or peculiar, this type of shoe cannot be worn; thus, it is necessary to obtain a form of the foot and prepare a "tailored" shoe.

OBJECT OF THE INVENTION

The object of the present invention is to propose a method for producing shoes, which can be adapted to the user's foot shape.

Another object of the present invention is to propose a method for producing shoes, which allows a particularly comfortable product to be easily obtained.

A further object of the present invention is to propose a method, whose carrying out does not require specialized staff.

The characteristic features of the present invention will be better pointed out in the following description of a preferred embodiment, in accordance with the contents of the claims and with help of the enclosed drawings, in which:

DESCRIPTION OF THE PREFERRED EMBODIMENTS

Figure 1:
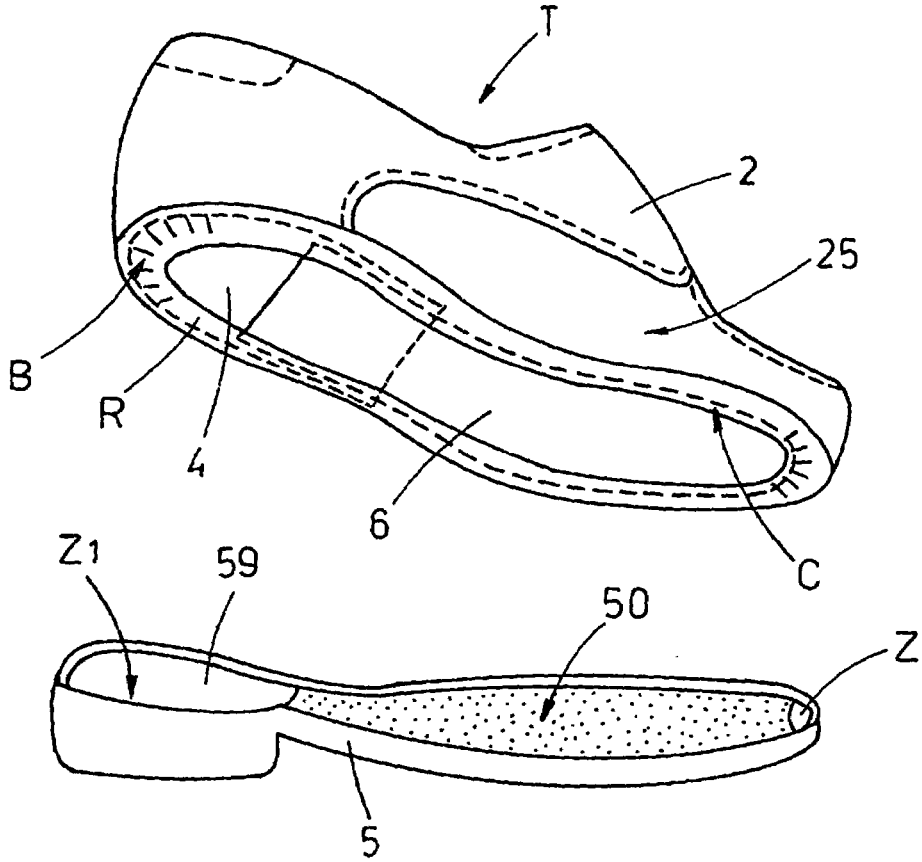
FIG. 1 is a perspective and partially exploded view of those parts which form a shoe obtainable by the proposed method.

According to the proposed method for producing a shoe, a shoe upper 2 must be obtained by assembling different parts, for example: an external layer 25 and, if required, a counter (not shown) joined by stitching to the rear portion of the external layer; an internal layer 26, called lining, complementary to the dimensions of the external layer 25, and fastened to the inner surface of the latter, and aimed at internal finishing of the shoe upper obtained as described above.

Moreover, the proposed shoe can be obtained by the use of a heel-insole 4, whose shape and size are prefixed, or an insole, and it is necessary to use a sole 5, whose shape and size are prefixed in relation to the size of the shoe to be obtained.

Taking into consideration the parts forming a shoe, an elastic element 6 is prepared, for example an elastic strip with a prefixed shape, e.g. similar to the fore central portion of the sole 5, but slightly smaller than the latter; otherwise, the elastic strip 6 can have a profile similar to the sole 5 profile, but slightly smaller.

According to a second embodiment, the elastic element 6 may include a plurality of elastic strips arranged side by side.

In relation to the dimensions and the shape of the elastic strip, it is necessary to scratch, a technique known to those skilled in the art as fleshing, the edge of the shoe upper, which is aimed at receiving, fastened thereto, the elastic strip.

In a first operation step, the elastic strip 6 is placed over the fleshed area of the shoe upper edge, and the edge C of the elastic strip 6 is fastened, for example by stitching and/or gluing, to the shoe upper fleshed area, for example along the sections facing the edges of the central-fore area of the shoe upper 2, to define a tubular assembly formed by the shoe upper and the elastic strip 6.

Otherwise, the elastic strip can be fastened to the peripheral edge of the lower portion of the shoe upper 2, to define a different shoe upper-strip assembly, which is not shown.

In the last case, it is possible to fasten the sole the shoe upper-strip assembly, without fitting the latter onto a last.

If the elastic strip 6 engages the central-fore portion of the shoe upper, the heel-insole 4 is placed and fastened, according to known techniques, to the rear portion of a last, not shown, so as to match with this rear portion.

After the heel-insole 4 has been placed on the last, the shoe upper 2 is fitted thereon.

Then, a layer of glue is applied to the area of the external edge B of the heel area of the heel-insole 4.

If a full insole is used, the layer of glue is applied to the external edge B of the heel area and to the external edge area of the insole toe, before the shoe upper is fitted onto the last.

Then, the edge R of the rear portion of the shoe upper 2, which is partially placed on the edge B of the heel-insole 4, is folded to fasten the shoe upper to the heel-insole 4, due to keeping the press joining of the edges R, B for a prefixed period of time; in this way, the shoe upper—heel-insole—strip T assembly, shown in FIG. 1, is obtained.

Otherwise, a mutual fastening can be obtained by applying a plurality of connecting means, or other means, to the folded edge R of the shoe upper 2, so as to engage the edge B of the heel-insole 4, situated below.

Figure 5:
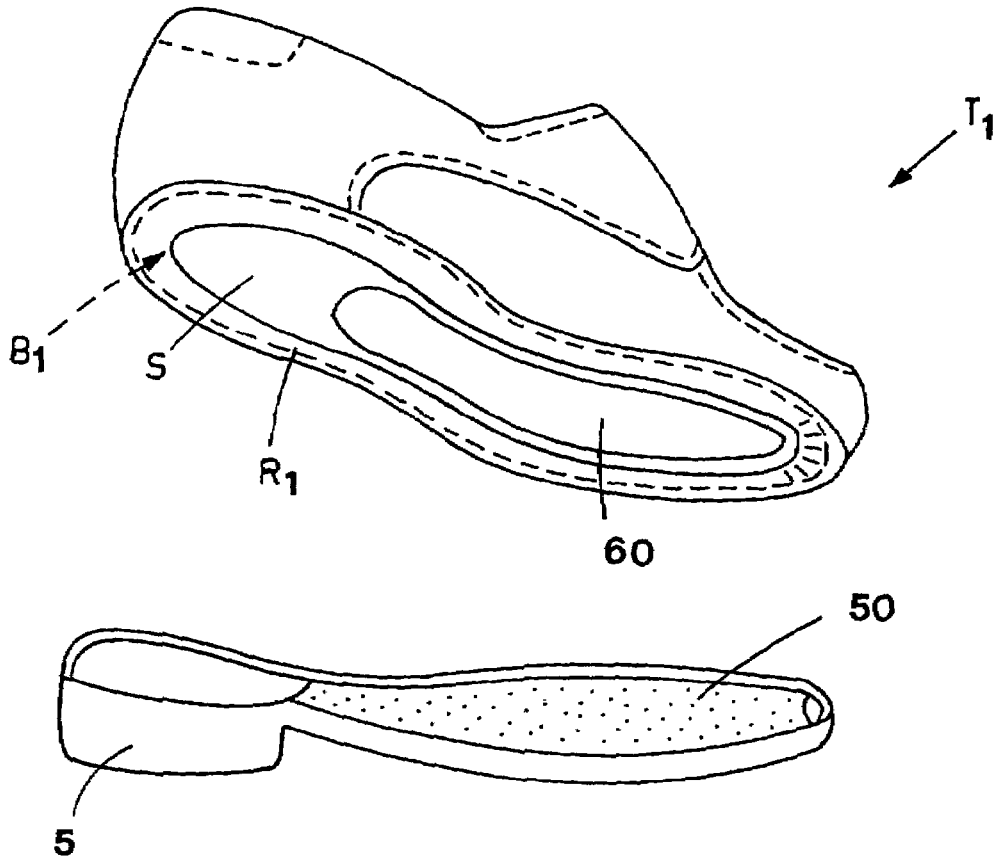
FIG. 5 is a perspective and partially exploded view of the parts, which form the proposed shoe, according to a second embodiment.

According to a second embodiment, shown in FIG. 5, an full insole S is used, which has, in its central-fore part, an elastic element 60, for example an elastic strip (or a plurality of elastic strips), with a predetermined shape, for example similar to the central fore portion of the insole, but smaller than the insole.

According to this embodiment, in a first step, the shoe upper 2 is fastened to the insole, pre-positioned and anchored to the last in known way.

The insole S can be fastened to the shoe upper by the application of a layer of glue to the external edge B1 of the insole S and folding the edge R1 of the shoe upper 2 over the edge B1 of the latter, to define, by keeping the pressed joining of the edges R1, B1, the shoe upper—insole—strip T1 assembly; connecting means or other means can be used instead of the glue.

Otherwise, the insole S can be fastened to the shoe upper 2 by stitching, by for example the so called "Bologna" stitch (FIG. 5A), to define the shoe upper—insole T1 assembly.

After the shoe upper—heel-insole—strip T assembly, or shoe upper—strip assembly, or shoe upper—insole T1 assembly, is formed, fastening means 50, for example adhesive means or velcro® of heat-plastic material, having a prefixed shape, are fastened to the surface 59 of the sole 5, according to known techniques, to define, on the sole, a fore fastening area Z and a rear fastening area Z1, in the sole toe-area and in the sole heel-area, respectively, and externally with respect to the fastening means, as shown in FIGS. 1, 5.

On the upper surface of the fastening means 50, there is a removable protective sheet, not shown, whose dimensions are equal to the dimensions of the fastening means 50 and which is provided laterally with a tongue going out from the sole 5.

According to a second embodiment, the fastening means 50 can be introduced in the sole of the sole 5, while the latter is being produced.

Figure 2:
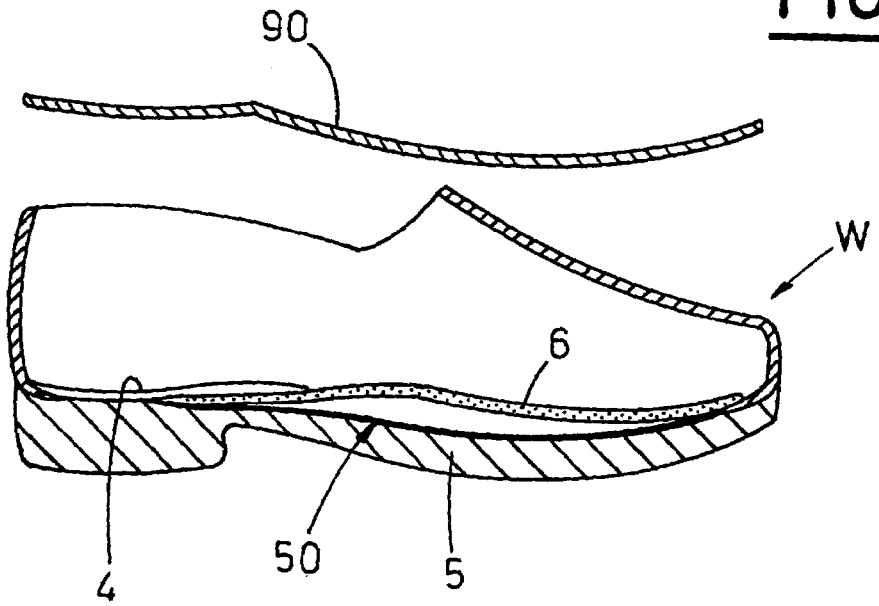
FIG. 2 is a lateral section view of the assembled parts of FIG. 1 and of an insole.
Figure 3:
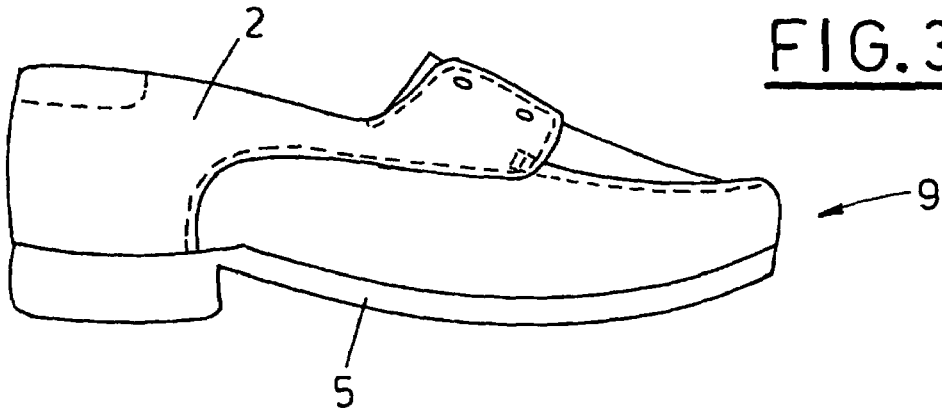
FIG. 3 is a lateral view of a shoe obtained by the proposed method.

During a subsequent step, the sole 5 is set in contact with the shoe upper—heel-insole—strip T assembly, shown in FIG. 2, or with the shoe upper—strip assembly, or with the shoe upper—insole T1 assembly.

Then the fore fastening area Z of the sole 5 and a corresponding fore portion, for example the toe area, of the shoe upper—heel-insole—strip T assembly, fitted on the last, or of the shoe upper—strip assembly, or of the shoe upper—insole T1 assembly, is fastened to the rear fastening area Z1 of the sole and a corresponding rear portion, for example, the heel area, of the shoe upper—heel-insole—strip T assembly, or of the shoe upper strip assembly, or of the shoe upper—insole T1 assembly, in order to obtain a sole—assembly group W, W1.

Figure 2A:
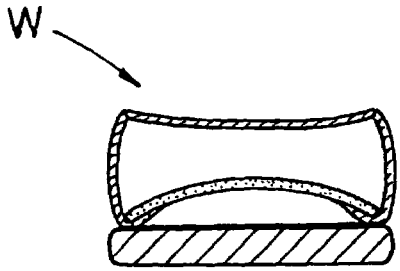
FIG. 2A is a front section view of what is shown in FIG. 2.
Figure 2B:
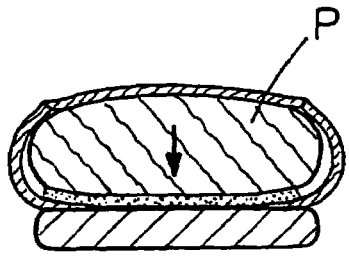
FIG. 2B is the same section as FIG. 2A during a subsequent operation step.

The elastic strip 6, 60 is not fastened to the fastening means 50, as shown in FIG. 2 and in the section of FIG. 2A.

According to a not shown embodiment, the fore area Z of the sole 5 is fastened in one point to the central fore portion of the shoe upper—heel-insole—strip T assembly, or of the shoe upper—strip assembly, or of the shoe upper—insole T1 assembly.

Afterwards, the sole—assembly group W, W1 is removed from the last.

After the sole—assembly group W, W1 has been obtained, during a subsequent step of the proposed method (shoe checking), a user puts his foot P into the shoe upper 2 of the sole—assembly group W, W1; the elastic strip 6, 60 stretches crosswise and the shoe upper 2 adapts to the user's foot shape.

Then, the sheet situated above the fastening means 50 is removed by pulling the relative tongue, and subsequently, the user's foot pushes to removably pre-fasten the elastic strip 6, 60 to the fastening means 50, so as to stabilize the extension of the elastic strip 6, 60, and therefore, to maintain the spatial conformation of the shoe upper 2.

Figure 4:
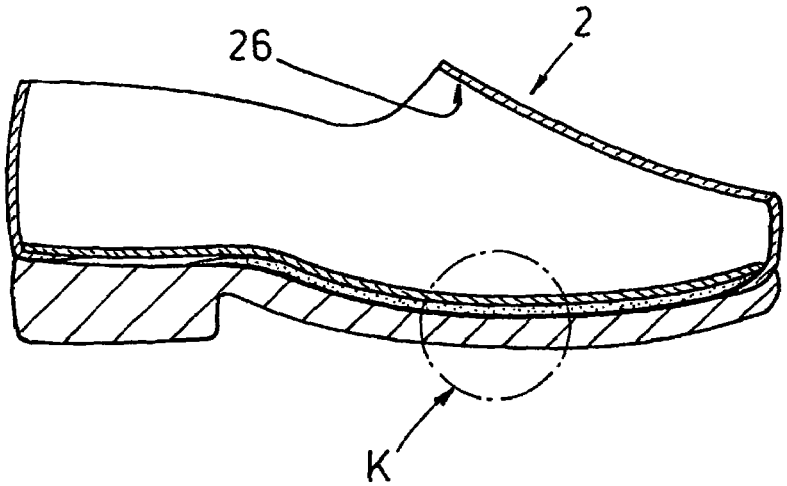
FIG. 4 is a lateral section view, taken along a longitudinal plane, of what is shown in FIG. 3.
Figure 4A:
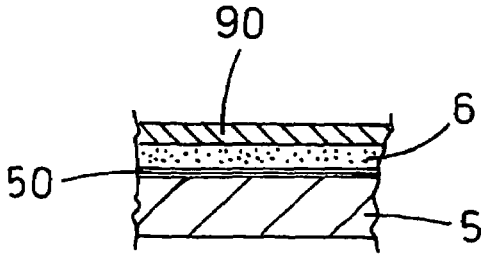
FIG. 4*a* is an enlarged view of the particular K of FIG. 4.
Figure 5A:
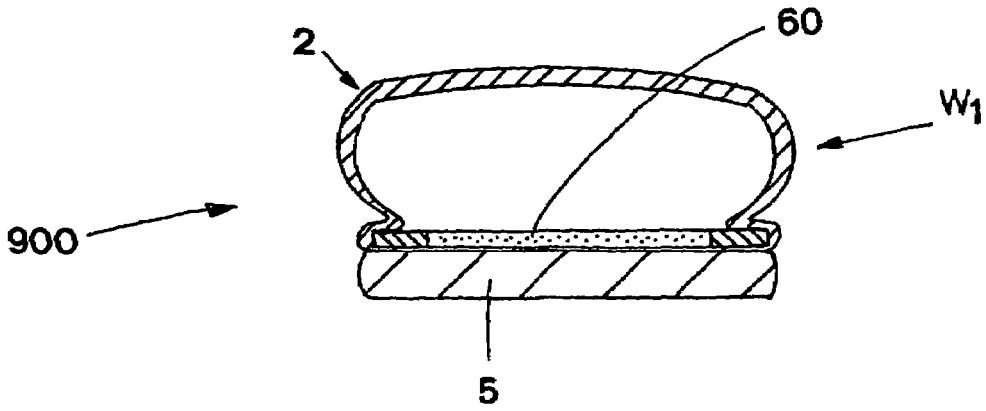
FIG. 5A is a front section view of the assembled parts of the second embodiment, with a different fastening of the shoe parts pointed out.

During the final step, the user removes his foot from the so deformed sole—assembly group W, W1 and pressing and/or heating means, for example a press, not shown, are introduced therein to press to sole 5, so that it joins and adheres to the assembly T, or to the shoe upper—strip assembly, or to the shoe upper—insole T1 assembly in the group W, W1, in order to obtain the desired shoe 9, 900, as shown in the section of FIGS. 4, 5A.

After the shoe 9, 900 is obtained, a finishing insole 90 is introduced thereinto and placed on the heel-insole 4, and/or on the elastic strip 6, or on the insole S and on the elastic strip 60.

According to a third embodiment (FIGS. 6, 7), the shoe upper 2, as described previously, is obtained by joining of an external layer 25 and an internal layer 26, or lining.

In this embodiment, the terminal portion 250 of the external layer 25 is separated from the terminal portion 260 of the lining, and an outer stitching U is made at a distance "d" from the edges of the portions.

The elastic element 6, 60 (either the elastic strip 6, or more elastic strips, or the insole S with its elastic element 60), is fastened to the terminal portion 260 of the lining, while the inner side L of the terminal portion 250 is covered with glue.

Figure 6:
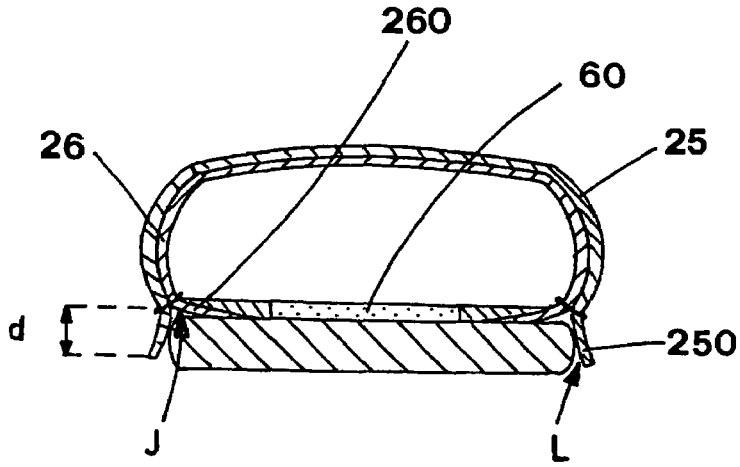
FIGS. 6, 7 are front section views of the assembled parts of the proposed shoe according to a third embodiment in two subsequent operation steps.
Figure 7:
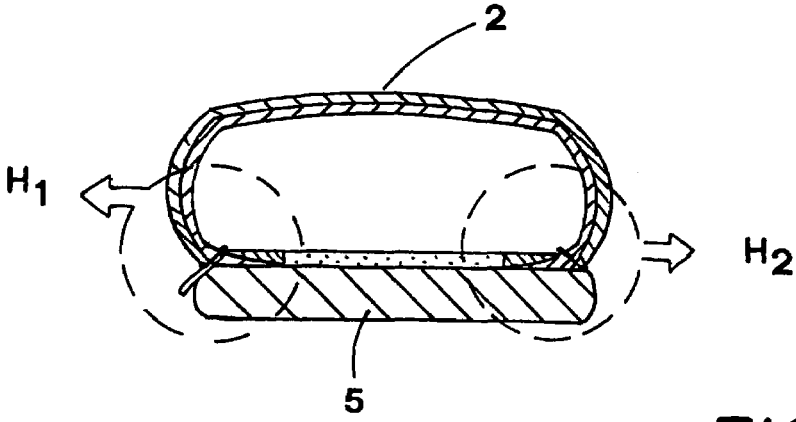

Due to the pre-fastening of the elastic element 6; 60 to the fastening means 50, the terminal portion 260 of the lining 26, in relation to the shoe upper 2 deformation, is fastened, wholly or partially, to the sole 5, in order to define a gap J between the terminal portion 260 of the lining 26 and the edge of the sole 5 (FIG. 6).

Figure 7A:
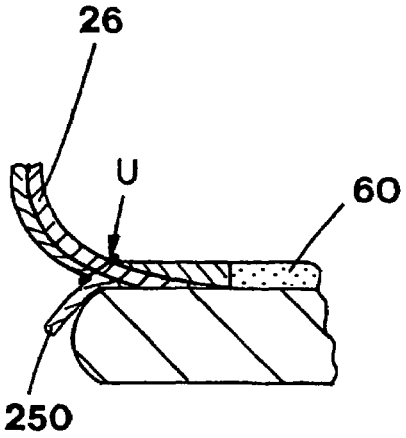
FIG. 7A is an enlarged view of the particular H1 of FIG. 7.
Figure 7B:
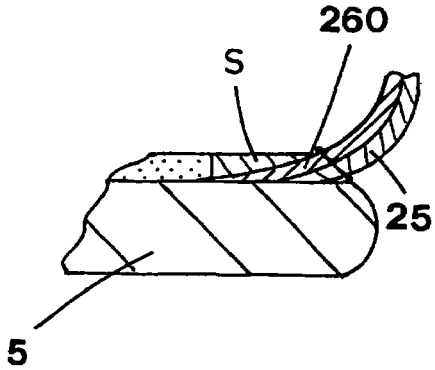
FIG. 7B is an enlarged view of the particular H2 of FIG. 7.

After the elastic element 6, 60 has been pre-fastened to the fastening means 50 or after the shoe 9, 900 has been obtained, the terminal portion 250 of the external layer 25 is wedged, by suitable instruments, into the gap J and is made adhere to the terminal portion 260 of the lining 26 (FIG. 7A); then the exceeding part of the terminal portion 250 of the external layer 25 is trimmed (FIG. 7B).

The above described method for producing a shoe has advantageous features.

The method allows to obtain an especially comfortable shoe, suitable for users having particular foot deformation.

The elastic element 6, 60 allows to adapt the shoe upper to the user's foot conformation, due to the introduction of the user's foot into the sole—assembly group W, W1.

The protective sheet situated above the fastening means 50, allows the user to put on the shoe upper, to check if the deformation of the latter is sufficient for the foot shape without "activating" the fastening means 50, and to decide freely whether to buy the shoe 9, 900 or not.

The fastening means 50 on the sole 5 allow to pre-fasten the shoe upper: if the user has not deformed the shoe upper correctly, the initial conformation of the shoe upper can be restored manually, i.e. the elastic strip 6, 60 is separated from the fastening means 50.

The pre-fastening of the shoe upper 2, adapted to the foot shape, to the sole 5, due to the fastening of the sole—assembly group W, W1, allows to obtain a personalized shoe 9, 900.

The sole 5 can be fastened to the group W, W1 by stitching or by use of glue, which suitably applied to the sole 5 activates the heat-welding or fusion of suitable materials, from which the elastic element 6, 60, the fastening means 50, and the other parts of the shoe, are made, so as to assure the seal between the sole 5 and the group W, W1.

The stitching U, made at the distance "d" from the terminal portion of the shoe upper 2, allows, after the shoe 9, 900 has been obtained, to finish perfectly the joining area between the sole edge and the terminal portion of the shoe upper 2.

The described method for producing shoes is also advantageous, because its operation steps are simple and do not require specialized staff.

It is understood that what above, has been described as a pure, not limiting example, therefore, possible variants of the invention, deriving from the practical use, remain within the protective scope of the present technical solution, as described above and claimed hereinafter.

The invention claimed is:

1. A method for producing shoes comprising the following steps:

obtaining an assembly (T,T1), formed by a shoe upper (2) and an elastic element (6,60), fastened to the shoe upper at least along sections facing lower edges of a shoe upper central-fore area;

obtaining a sole (5), having a size which corresponds to a size of said shoe upper, and whose upper surface has fastening means (50), engaging at least a central-fore portion thereof, so that the upper surface defines at least one fore fastening area (Z) and at least one rear fastening area (Z1);

mutual fastening of the fore fastening area (Z) of the sole (5) to a corresponding fore portion of said assembly, and of the rear fastening area (Z1) of the sole (5) to a corresponding rear portion of said assembly, to obtain a sole-assembly group (W,W1);

introducing a user's foot into the sole-assembly group (W,W1), with a subsequent transversal stretching of said elastic element (60) and adaptation of said shoe upper (2) to the foot conformation;

pre-fastening said elastic element to the fastening means (50), by pressing the user's foot onto said elastic element;

removing the user's foot from the sole-assembly group (W,W1); and, joining the sole-assembly group (W,W1), to obtain a shoe.

2. A method according to claim 1, characterized in that said group (W1) is obtained by the following steps:

placing said elastic element onto the face of a corresponding last;

fitting the shoe upper (2) onto the last;

fastening said elastic element at least to the opposite sections of the lower edges of the shoe upper central-fore area;

and in that after said group (W1) has been obtained, it is removed from the last.

3. A method according to claim 1 or 2, characterized in that said elastic element is situated in the central-fore part of a corresponding insole (S), with the latter being fastened to the shoe upper lower edges.

4. A method according to claim 3, characterized in that said opposite edges of the shoe upper (2) are fleshed before said elastic element is fastened thereto.

5. A method according to claim 3, characterized in that said elastic element is fastened to said lower edges of the shoe upper (2) by stitching.

6. A method according to claim 3, characterized in that said elastic element is fastened to said lower edges of the shoe upper (2) by the application of adhesive means onto the surface of at least the edges of the shoe upper (2) aimed at being joined to a corresponding portion of said elastic element.

7. A method according to claim 3, characterized in that said elastic element has the shape similar to the central fore portion of the insole (S) and is inscribed therein.

8. A method according to claim 1 or 2, characterized in that said opposite edges of the shoe upper (2) are fleshed before said elastic element is fastened thereto.

9. A method according to claim 1, characterized in that at least said fore fastening area (Z) is external to the fastening means (50).

10. A method according to claim 1, further comprising fitting said assembly (T,T1) on a corresponding last before being fastened to said sole (5), and in that after said sole-assembly group (W,W1) has been obtained, removing the assembly (T,T1) from the last.

11. A method according to claim 10, characterized in that, before fitting of the group (W) onto the last, a heel-insole is placed on the rear portion of the surface of the last, and subsequently, the heel-insole is fastened to the shoe upper.

12. A method according to claim 10, characterized in that, before fitting of the group (W) onto the last, an insole is placed on the surface of the last, and subsequently, the heel area and the toe area of the insole are fastened to the shoe upper.

13. A method according to claim 2, in which said shoe upper (2) is formed by an external layer (25) and an internal layer (26), or lining, characterized in that before the shoe upper (2) is fitted onto the last, the terminal portions (250, 260) of said external layer (25) and said lining (26), respectively, are separated and a stitching (0) is made at a distance ("d") from said external layer (25) and said lining (26).

14. A method according to claim 1, characterized in that a protective sheet touching the upper part of the fastening means (50) is removed before said elastic element is pre-fastened to the fastening means (50).

15. A method according to claim 1 or 2, characterized in that said elastic element is fastened to said lower edges of the shoe upper (2) by stitching.

16. A method according to claim 1 or 2, characterized in that said elastic element is fastened to said lower edges of the shoe upper (2) by the application of adhesive means onto the surface of at least the edges of the shoe upper (2) aimed at being joined to a corresponding portion of said elastic element.

17. A method according to claim 13, characterized in that said insole (8), together with its elastic element (60) is fastened to said terminal portion of said lining (26) by stitching.

18. A method according to claim 13, characterized in that said insole (8), together with its elastic element (60) is fastened to said terminal portion of said lining (26) by adhesive means.

19. A method according to claim 13, characterized in that said elastic element (6) is fastened to said terminal portion (260) of said lining (26) by stitching.

20. A method according to claim 13, characterized in that said elastic element (6) is fastened to said terminal portion (260) of said lining (26) by adhesive means.

21. A method according to claim 13, characterized in that the terminal portion (250) of said external layer (25) is joined to said terminal portion (260) of said lining (26) before the shoe (9,900) is obtained.

22. A method according to claim 1, characterized in that the sole—assembly group (W,W1) is joined by heating said group and pressing the assembly (W,W1) against the sole (5).

23. A method according to claim 1, characterized in that after the shoe (9,900) has been obtained, a finishing insole (90) is placed thereinside.

* * * * *